United States Patent [19]

Yagusic et al.

[11] 4,018,070

[45] Apr. 19, 1977

[54] ELECTRO-MECHANICAL DRIVE FOR TORSION WINDERS AND THE LIKE

[75] Inventors: George Joseph Yagusic, Litchfield; Bernard Pierre Lampietti, Goshen, both of Conn.

[73] Assignee: Torin Corporation, Torrington, Conn.

[22] Filed: Sept. 30, 1975

[21] Appl. No.: 618,169

[52] U.S. Cl. ..... 72/19; 72/23; 72/142

[51] Int. Cl.[2] ..... B21F 3/04

[58] Field of Search ..... 72/DIG. 17, 19, 21, 72/22, 23, 30, 138, 142, 143, 135; 140/82; 242/DIG. 1, 7.13, 7.14; 318/71, 85, 675

[56] References Cited

UNITED STATES PATENTS

| | | | |
|---|---|---|---|
| 2,806,507 | 9/1957 | Stofko | 72/142 |
| 3,024,395 | 3/1962 | Pedersen et al. | 318/71 |
| 3,184,668 | 5/1965 | Whitecar | 318/85 X |
| 3,231,801 | 1/1966 | Lang | 318/85 X |
| 3,433,041 | 3/1969 | Cavagnero et al. | 72/138 |
| 3,906,766 | 9/1975 | Sato | 72/138 |

FOREIGN PATENTS OR APPLICATIONS

| | | | |
|---|---|---|---|
| 1,219,058 | 1/1971 | United Kingdom | 72/143 |

*Primary Examiner*—C.W. Lanham
*Assistant Examiner*—E. M. Combs
*Attorney, Agent, or Firm*—McCormick, Paulding & Huber

[57] ABSTRACT

An electro-mechanical drive for use between mechanically independent master and slave rotary elements, as for example the cam shaft and spring winding spindle of a spring winding machine of the type commonly known as a torsion spring winder. A harmonically cut cam on the cam shaft operates a follower which in turn drives adjustably interconnected first and second slides respectively driving a rack and an associated pinion and an oscillable lever. The lever in turn imparts axial movements to the winding spindle as may be required for pitching torsion springs wound thereon. The pinion operated by the rack in turn drives a direct current tachometer generator which provides a variable voltage signal having a cyclically repetitive wave form with sloped leading and trailing edges and, more particularly, a voltage at least approximately in the form of a sine wave. The sine wave is rectified to provide for a half wave form voltage signal to a servo motor and controller in turn connected in driving relationship with the slave rotary element or winding machine spindle. The spindle is thus operated to wind springs thereon and the relative angular velocity of master and slave, or cam shaft and spindle, is controlled by a manually adjustable potentiometer which varies the amplitude of the half wave signal to the servo motor and controller. A desired number of turns of the spindle is thus provided for each cam shaft revolution and the desired characteristics of the spring are obtained.

21 Claims, 2 Drawing Figures

ELECTRO-MECHANICAL DRIVE FOR TORSION WINDERS AND THE LIKE

BACKGROUND OF THE INVENTION

As in a wide variety of other machinery, a spring winding machine of the type commonly known as a torsion spring winder requires that master and slave rotary elements be interconnected and driven in a specific timed relationship. More particularly, the master element or cam shaft in a torsion winder and the slave element or spindle must be rotated at various preselected relative angular velocities in order to provide for desired spring characteristics. That is, the number of turns in the springs to be produced may vary widely over a range and, accordingly, the number of spindle revolutions per cam shaft revolution must be capable of precise control and adjustment over a wide range.

Mechanical and other means have heretofor been provided for maintaining the desired relationship between master and slave elements or cam shaft and spindle in torsion winders but have been found lacking in the desired ease and convenience of adjustment, flexibility, etc. Illustrative examples of spring winding machines may be found in U.S. Pat. No. to Sampatacos et al. 2,697,470, Sampatacos et al. U.S. Pat. No. 2,788,807 and Cavagnero et al. U.S. Pat. No. 3,433,041.

SUMMARY OF THE INVENTION

It is the general object of the present invention to provide an electro-mechanical drive particularly well-suited to use in spring winding machines but adapted also for general purpose use and which provides a high degree of flexibility, simplicity, ease and convenience in establishing and maintaining selected timed relationships between master and slave rotary elements.

In fulfillment of this object a signal generator and transducer means is connected with a master rotary element and operates to provide an electrical output signal in the form of a variable voltage which has a cyclically repetitive wave form with sloped leading and trailing edges. A servo motor and controller is connected with and operated by the signal generator and transducer means and comprises a precisely regulated high response DC motor with associated power supply and control amplifier. Such units, commonly known as a fast response high gain servo controller and motor, are capable of controlling angular velocity within plus or minus one per cent (1%) as established by an input electrical voltage signal. Such units are also capable of high positive and negative accelerations on the order of one thousand RPM per 50 milliseconds. Thus, the servo motor and controller are provided with response characteristics at least equal to the slope of the leading and trailing wave edges and the motor is connected in driving relationship with the spindle or slave rotary element whereby to rotate the latter at angular velocities variable with the electrical signal to the controller.

A manually adjustable means in the form of a potentiometer is provided between the signal generator and transducer means and the servo motor and controller whereby to vary the amplitude of the wave form and thus to control the relative angular velocity of master and slave rotary elements. With a diode or other rectifying means a half wave form is provided for intermittent unidirectional rotation of the slave rotary element responsive to continuous rotation of the master rotary element and, in the case of a torsion winder cam shaft and spindle, intermittent winding of springs on the spindle is thus provided for. With the adjustable amplitude varying means a desired number of revolutions of the spindle for each revolution or partial revolution of the cam shaft can be provided for over a wide range, for example, on the order of 1 to 100 spindle revolutions. Thus, springs of the desired number of turns can be readily wound.

An overriding means operable at a terminal portion of each half wave form and intermittent unidirectional rotation of the slave element is provided in a second embodiment of the invention and comprises a secondary voltage source and a manual adjustment means in the form of a potentiometer. A first sensor responsive to the angular position of the slave element or spindle is operable to terminate the secondary voltage when the slave element reaches a precise preselected angular position. A second sensor responsive to the signal generator and transducer means and operated thereby at a terminal portion of each half wave form is connected with a switching means which may include a bistable element. The bistable element is responsive to the second sensor and has an associated relay means operated thereby and which disconnects the signal generator and transducer means and connects the secondary voltage means with the controller and servo motor at the said terminal portion of each half wave form. Thereafter, and on satisfaction of the angular position sensor at the spindle the connections are once again reversed for precise termination of spindle rotation by the first sensor.

DESCRIPTION OF PREFERRED EMBODIMENTS

Figure 1:
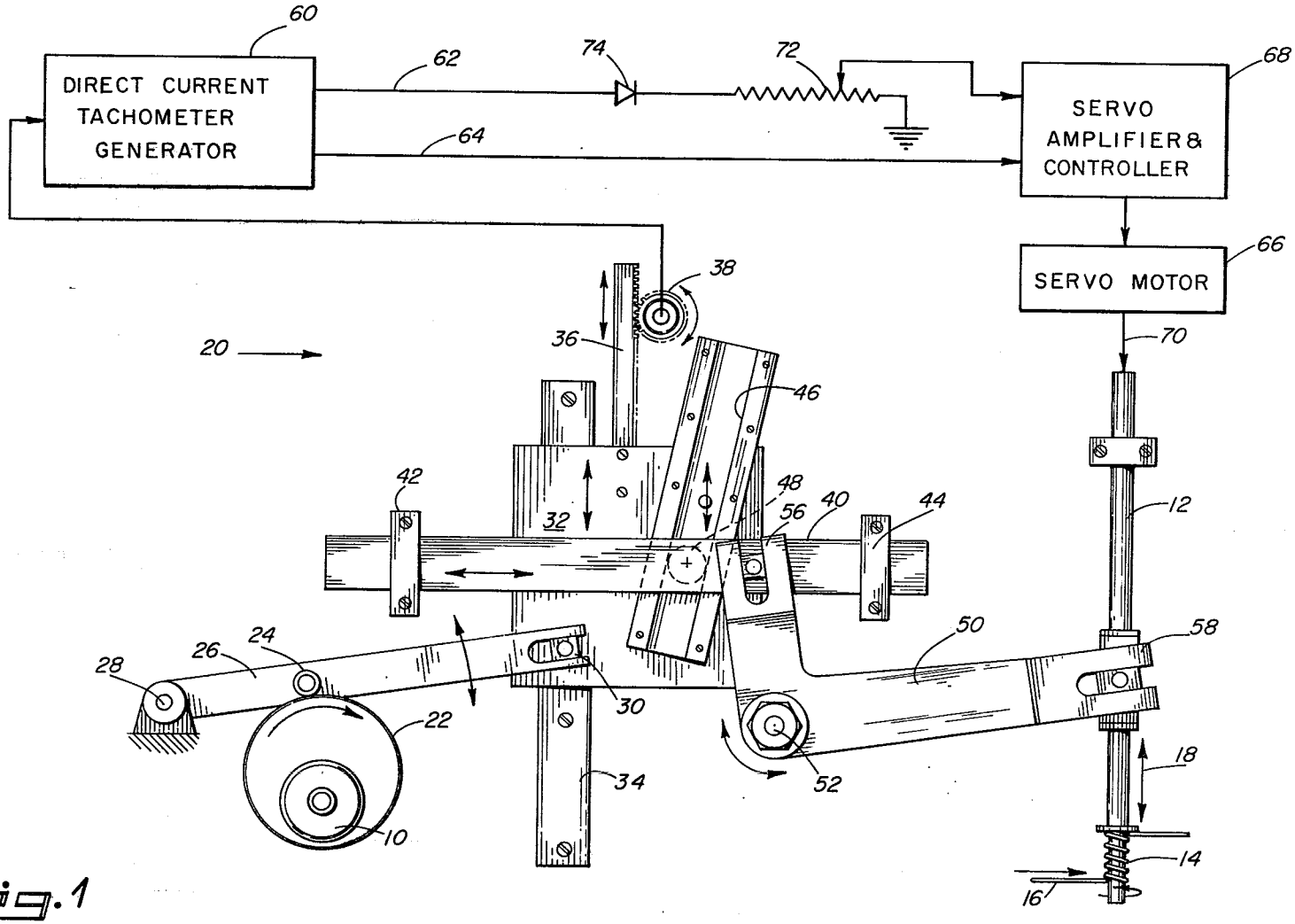
FIG. 1 is a schematic illustration of the electromechanical drive of the present invention as employed in a spring winding machine, which machine also includes a means for effecting axial movements of a slave rotary element or spindle in timed relationship with rotary movements thereof.

Referring particularly to FIG. 1, it will be observed that master and slave rotary elements are indicated respectively at 10 and 12. The master element 10 takes the form of a cam shaft in a spring winding machine or torsion winder which shaft is rotated continuously and the slave element takes the form of a spindle in such a machine, the spindle being rotated intermittently as is conventional for the winding of springs such as 14 thereabout. As will be apparent, wire 16 is drawn toward the spindle and wound thereabout during rotation of the latter and axial movement of the spindle is required as indicated by the arrow 18 for pitching of the spring. Moreover, the rotation of the spindle and the axial movement thereof must be effected in precisely timed relationship in order to provide a spring of the desired characteristics. Torsion springs are commonly wound on machines of the type under consideration and such machines are commonly referred to as torsion winders. Other elements in the machine are or may be conventional such as means for initially feeding wire to the spindle, means for cutting off springs after they have been wound on the spindle, means for forming end portions of the springs etc. Machines of the type under consideration may be adapted to wind at a production rate of a few springs per minute to a rate of more than a hundred springs per minute. Further, the number of turns required of the spindle per spring may vary in a range of 1 to 100.

In accordance with the present invention, a signal generator and transducer means is connected with and driven by the master rotary element or cam shaft 10 and provides an electrical output signal in the form of a variable voltage which has a cyclically repetitive wave form with sloped leading and trailing wave edges. In the embodiments of the invention shown, a variable voltage at least approximately in the form of a sine wave is employed but it will be obvious that various other cyclically repetitive wave forms can be used. Wide variation in the form of the signal generator and transducer means is also contemplated within the scope of the invention. As shown and presently preferred, however, a cam and follower means is provided with the cam 22 mounted on and rotatable with the cam shaft 10. Cam 22 is at least approximately harmonically cut to provide a sine wave and a follower 24 is mounted on an oscillable lever 26 pivoted at 28 and driving a small pin 30 at an opposite end. The pin 30 is mounted on a first slide 32 which is vertically movable along a guideway 34. Attached to and reciprocated vertically by the slide 32 is a vertical rack 36 which in turn drives a pinion 38 in one and an opposite direction. Also driven by the slide 32 is a second slide 40 which is supported in guides 42–44 for horizontal movement and which has an adjustable connection with the first slide 32. That is, an inclined guideway 46 receives a roller or pin 48 projecting rearwardly from the slide 40 and, during vertical reciprocation of the slide 32, and the guideway 46, the roller 48 serves to drive the slide 40 in its horizontal reciprocation. As will be apparent, the guideway 46 may be adjusted on the slide 32 so as to vary its angle of inclination from the vertical and thereby adjust the amount or degree of travel of the slide 40 during each reciprocation.

As oscillable lever 50 pivoted at 52 is connected at one end portion 56 with the horizontal slide 40 and, at an opposite end portion 58 the lever 50 is connected with the slave element or spindle 12 so as to translate or axially move the latter in one and an opposite direction and thereby to effect pitching of a spring 14 wound thereabout. The amount or degree of axial movement of the spindle together with the number of turns of the spindle will of course determine the pitch of the spring 14 wound on the spindle. During a first half revolution of the cam shaft 10, shown slightly beyond one half revolution, a spring is wound on the spindle 12 with the spindle being moved axially by the lever 50 in an upward direction. During a second half revolution of the cam shaft 10 and after the spring has been severed from the wire 16, the spindle 12 is moved axially downwardly in a return stroke for the winding of a subsequent spring.

The pinion 38 operated by the rack 36 in turn drives a direct current tachometer generator 60 which is connected by lines 62–64 with a DC servo motor and its controller as mentioned above. The servo motor is indicated at 66, a servo amplifier and controller at 68, and the connection of the motor with the spindle 12 for driving same is indicated by line 70. Both the direct current tachometer generator and the servo motor and controller may vary in form. Illustrative examples comprise an INLAND MOTORS TG 2170D for the tachometer generator and, for the servo motor and its controller, an INDIANA GENERAL MOTOR SD216, NC122F CONTROL.

A manually adjustable means provided between a signal generator and transducer means 20 and the servo motor and controller 66,68 may take the form of a potentiometer indicated generally at 72 and which is adapted to be manually adjusted. As will be apparent, the potentiometer may be adjusted to vary the amplitude of the wave form supplied to the motor and controller and, a rectifying means such as a diode 74 is also provided so that a half wave form is supplied to the motor and controller for intermittent unidirectional rotation of the spindle 12. Thus, during each half revolution of the cam 22, for example ending approximately as shown, the spindle 12 will be rotated at a predetermined angular velocity with respect to the cam shaft 10 and, more particularly, the spindle will be rotated through a preselected number of turns as determined by the setting of the potentiometer 72. With the sloped leading end and trailing edges of the half wave form of the voltage signal, well within the response capabilities of the servo motor and controller, the control of the spindle 12 by the cam shaft will be precise and a high degree of accuracy in the spring winding is thus achieved. Further, a high degree of ease and convenience in presetting a desired number of turns is provided in the mere adjustment of the potentiometer 72. Pitch adjustment is also achieved in the simple operation involving the angular adjustment of the guideway 46.

Figure 2:
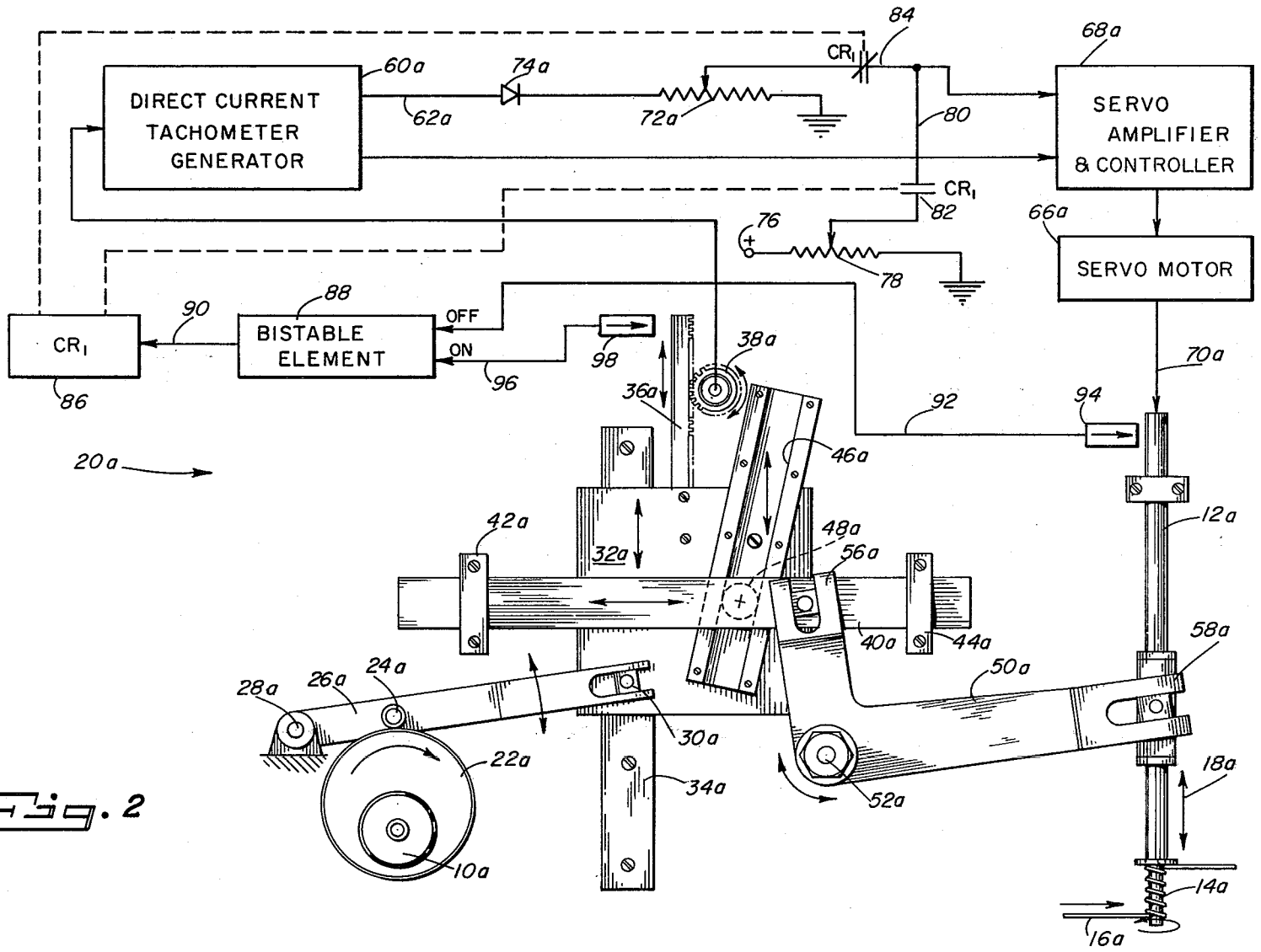
FIG. 2 is a schematic illustration of a second embodiment of the electro-mechanical drive of the present invention, which embodiment includes means for overriding a primary voltage signal during a terminal portion of each of a series of half waves and substituting a secondary voltage signal, the latter being terminated precisely at a preselected angular position of the slave rotary element or spindle by direct control from a spindle sensor.

Referring now to FIG. 2, it will be observed that reference numerals having the suffix *a* represent elements similar or identical to those described above. In the embodiment of FIG. 2, however, a means is provided for overriding the aforementioned voltage signal to the servo controller and motor at a terminal portion of each half wave form and a corresponding intermittent unidirectional rotation of said slave element or spindle 12. A low level secondary voltage may be provided by a source 76, a second manually adjustable potentiometer 78, a line 80 extending to the aforementioned line **62*a* to the controller and motor 66*a* and a first reed relay 82 in the line. A second reed relay 84 is interposed in the line 62*a* and the said two relays are controlled by a relay coil 86 in turn under the control of a bistable element 88 through a line 90. The bistable element 88 is connected by a line 92 from its "off" terminal with a sensor 94 located adjacent and responsive to the angular position of the spindle 12*a*. A line 96 connects a sensor 98 with the bistable element at an "on" terminal of the latter. The sensor 98 is located adjacent to and is responsive to the linear movement of the rack 36*a*. The sensors 94 and 98** are preferably of a fast response magnetic type.

When the sensor 98 properly positioned adjacent a terminal portion of a reciprocatory movement of the rack **36*a* the bistable element 98 will be operated thereby during each voltage half wave form and at a selected terminal portion thereof to operate the relay coil 86 whereby to open the relay 84 and to close the relay 82. Thus, a low level secondary voltage signal from the source 76 and potentiometer 78 will be provided to the servo motor and controller 66***a*, 68*a*. When the spindle 12*a* in a corresponding terminal portion of its unidirectional rotation reaches a precise angular position as to satisfy the sensor 94, the bistable element 88, through its "off" terminal, will operate to cause the coil 86 to reverse connections i.e., to close the relay 84 and open the relay 82 as shown. Thus, a precise termination of each rotation of the spindle 12*a* is provided for.

While the overriding means of the FIG. 2 embodiment is not deemed necessary for the accuracy required in a large majority of uses of the electromechanical drive of the present invention, it is nevertheless deemed a desirable expedient when exceptionally stringent requirements are encountered in angular positioning of a slave element. The high degree of accuracy of the basic form of the invention in FIG. 1 will suffice in most instances.

We claim:

1. The combination in a torsion winder comprising mechanically independent master and slave rotary elements, said elements comprising respectively a cam shaft and a spring winding spindle, signal generator and transducer means connected with said master rotary element and operable to provide an electrical output signal in the form of a variable voltage having a cyclically repetitive waveform with sloped leading and trailing wave edges, and a servo motor and controller connected with and operated by said signal generator and transducer means, said servo motor and controller comprising a precisely regulated high response DC motor and associated power supply and control amplifier, said motor having a response characteristic at least equal to the slope of said leading and trailing wave edges and being capable of high positive and negative accelerations on the order of one thousand RPM per 50 milliseconds, and said servo motor and controller also being connected in driving relationship with said slave rotary element and operable to rotate the latter at an angular velocity variable within approximately 1% of said electrical output signal.

2. The combination as set forth in claim 1 wherein said signal generator and transducer means includes a cam and follower means connected with and driven by said master rotary element and a mechanical to electrical transducer connected with and operated by said follower means.

3. The combination as set forth in claim 2 wherein said mechanical to electrical transducer includes a direct current tachometer generator.

4. The combination as set forth in claim 3 wherein a rack and pinion connection is provided between said follower means and said direct current tachometer generator.

5. The combination as set forth in claim 1 wherein a manually adjustable means is provided between said signal generator and transducer means and said servo motor and controller for varying the amplitude of said waveform and thereby controlling the relative angular velocity of said master and slave rotary elements.

6. The combination as set forth in claim 1 wherein said signal generator and transducer means provide a variable voltage having a cyclically repetitive waveform at least approximating a sine wave.

7. The combination as set forth in claim 1 wherein said signal generator and transducer means and said servo motor and controller provide for half wave form intermittent and unidirectional rotation of said slave rotary element responsive to continuous rotation of said master rotary element.

8. The combination as set forth in claim 7 and including means responsive to the angular position of said slave rotary element operable to override the aforesaid means controlling said servo motor at a terminal portion of each half wave form and intermittent unidirectional rotation of said slave element.

9. The combination as set forth in claim 8 wherein said overriding means comprises a means providing a secondary voltage to said controller and servo motor, and a sensor responsive to angular position of said slave rotary element and operable to terminate said secondary voltage when said slave element reaches a preselected angular position.

10. The combination as set forth in claim 9 wherein said overriding means comprises a second sensor responsive to said signal generator and transducer means and operated thereby at a terminal portion of each half wave form and intermittent unidirectional rotation of said slave element, and wherein said overriding means also comprises a switching means operated by said two sensors to cause said secondary voltage to operate and to terminate operation of said controller and servo motor.

11. The combination as set forth in claim 10 wherein said switching means comprises a bistable element having "off" and "on" terminals connected respectively with said angular position sensor and said second sensor, and relay means operated by said bistable element for disconnecting said signal generator and transducer means and for connecting said secondary voltage means with said controller and servo motor at said terminal portion of each half wave form, and for thereafter reversing said connections when said angular position sensor is satisfied.

12. The combination as set forth in claim 7 wherein said slave rotary element is supported for both rotation and axial movement, and wherein mechanical means is provided between said signal generator and said slave rotary element for effecting axial movement of the same in timed relationship with its rotation.

13. The combination as set forth in claim 12 wherein said signal generator and transducer means includes a cam and follower means connected with and driven by said master rotary element and a mechanical to electrical transducer connected with and operated by said follower means, and wherein said mechanical means comprises a first slide connected with and movable in one and an opposite direction by said follower means, and means connected between said slide and said slave rotary element for moving the latter in one and opposite axial directions.

14. The combination as set forth in claim 13 wherein said signal generator and transducer means includes a direct current tachometer generator and a rack and pinion connection between said generator and said first slide.

15. The combination as set forth in claim 14 wherein a second slide is provided and is connected with and operated by said first slide for movement in one and opposite directions for axial movement of said slave rotary element as aforesaid, said connection between said two slides being adjustable for varying the magnitude of the movement imparted to said second slide and slave element relative to the movement of said first slide.

16. The combination as set forth in claim 15 wherein an oscillable lever is provided between said second slide and said rotary slave element.

17. The combination as set forth in claim 15 wherein said adjustable connection between said two slides takes the form of an inclined guideway adjustably mounted on one of said slides and a follower entered in and slidable along said guideway and mounted on said other slide.

18. The combination as set forth in claim 17 and including means responsive to the angular position of said slave rotary element operable to override the aforesaid means controlling said servo motor as a terminal portion of each half wave form and intermittent unidirectional rotation of said slave shaft.

19. The combination as set forth in claim 18 wherein said overriding means comprises a means providing a secondary voltage to said controller and servo motor, and a sensor responsive to angular position of said slave rotary element and operable to terminate said secondary voltage when said slave element reaches a preselected angular position.

20. The combination as set forth in claim 19 wherein said overriding means comprises a second sensor responsive to movement of said rack in said signal generator and transducer means and operated thereby at a terminal portion of each half wave form and intermittent unidirectional rotation of said slave element, and wherein said overriding means also comprises a switching means operated by said two sensors to cause said secondary voltage to operate and to terminate operation of said controller and servo motor.

21. The combination as set forth in claim 20 wherein said switching means comprises a bistable element having "off" and "on" terminals connected respectively with said angular position sensor and said second sensor, and relay means operated by said bistable element for disconnecting said signal generator and transducer means and for connecting said secondary voltage means with said controller and servo motor at said terminal portion of each half wave form, and for thereafter reversing said connections when said angular position sensor is satisfied.

* * * * *